United States Patent [19]

Hofmann

[11] Patent Number: 4,471,913

[45] Date of Patent: Sep. 18, 1984

[54] SPRAY SHOWER WITH FLAT FAN NOZZLES

[75] Inventor: Hans J. Hofmann, Nashua, N.H.

[73] Assignee: Spraco, Inc., Nashua, N.H.

[21] Appl. No.: 357,991

[22] Filed: Mar. 15, 1982

[30] Foreign Application Priority Data

Oct. 28, 1981 [DE] Fed. Rep. of Germany ..... 3142663

[51] Int. Cl.[3] ..... B05B 1/20

[52] U.S. Cl. ..... 239/550; 239/567; 239/599

[58] Field of Search ..... 239/596, 599, 600, 550, 239/567

[56] References Cited

U.S. PATENT DOCUMENTS

| | | | |
|---|---|---|---|
| Re. 31,163 | 3/1983 | Gardner | 239/600 |
| 2,665,946 | 1/1954 | Broughton | 239/600 |
| 3,203,629 | 8/1965 | Goddard | 239/600 |
| 3,709,436 | 1/1973 | Foster | 239/550 |
| 4,025,045 | 5/1977 | Kubiak | 239/599 |

FOREIGN PATENT DOCUMENTS

| | | | |
|---|---|---|---|
| 1302088 | 7/1962 | France | 239/550 |
| 7917 | of 1907 | United Kingdom | 239/550 |
| 321294 | 11/1971 | U.S.S.R. | 239/599 |

*Primary Examiner*—Andres Kashnikow
*Assistant Examiner*—Jon M. Rastello
*Attorney, Agent, or Firm*—Charles Hieken

[57] ABSTRACT

A spray shower (10) is equipped with flat fan nozzles (17), having a dome shaped indentation (21) directed to the pipe inside, and located inside a nozzle base (12), attached to the outer surface of the pipe wall, at which the adjustment at the nozzle discharge orifice (22) in relation to the longitudinal axis (24) of the spray-shower (10) results from a corresponding fixation of the nozzles (17) inside the nozzle base (12). The flat fan nozzle has at the outer circumference several sides (20) and on the inner circumference of the nozzle base (12) are tip stretched corresponding sides (19) used as stops for the sides (20) of the flat fan nozzles (17). An arrangement of the spray-shower in such a manner obtains the advantage of a quick and problemless assembly of the flat fan nozzles in the required exact position, without the need for special skills of the assembler. Time consuming controls of the exact position of the nozzle discharge orifice after assembly and eventual correction is no longer necessary. In addition, the arrangement of the spray-shower conforming to the invention simplifies eventual changes of flat fan nozzles (in case of wear or clogging). Finally, the mentioned characteristics of the invention make possible an angular adjustment of the nozzle discharge orifice in relation to the longitudinal axis of the spray-shower by only removing, turning and subsequent reinstalling the nozzles in the new required angular direction.

15 Claims, 4 Drawing Figures

SPRAY SHOWER WITH FLAT FAN NOZZLES

Figure 2:
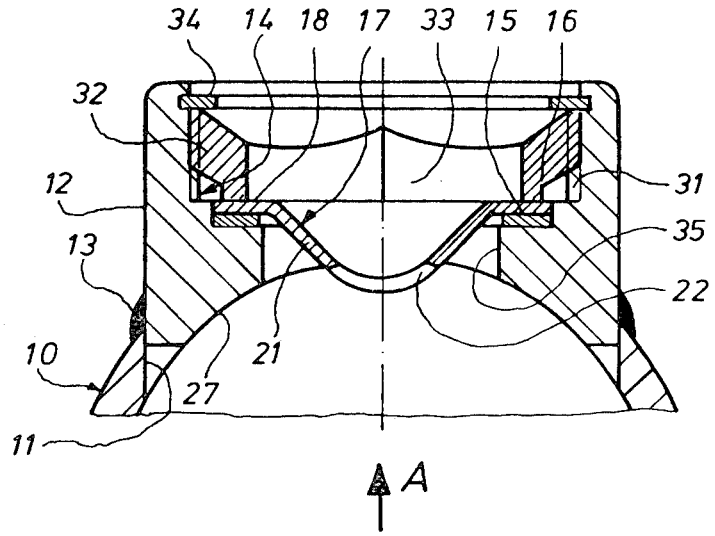

The invention is related to a spray-shower with flat fan nozzles, in which flat fan nozzles, having a dome-shaped indentation directed to the pipe inside, are located inside a nozzle base, fixed to the outer surface of the pipe wall, and the alignment of the discharge orifice in relation to the longitudinal of the pipe results from a respective fixation of the nozzles inside the nozzle base.

Showers of the above mentioned type are used, for example, in the pulp and paper industry. Here it is necessary to align the flat fan nozzles, equally spaced on the generatrix of the spray-shower, with regard to their discharge orifice in such a way that each flat spray pattern is not obstructed by another. With a slight skewing (of about 7.5°) of the nozzle discharge orifice in relation to the longitudinal axis of the spray pipe this goal will be obtained. The flat spray patterns are no longer aligned along the pipe direction, but inclined within a closed angle (approximately 7.5°) against the longitudinal axis of the shower pipe resulting in a parallel direction of the flat pattern. This inclined location of the discharge orifice also results in an overlap of the ends of the flat spray patterns.

Another important requirement of such spray-showers is that the flat fan nozzles having the dome shaped indentation extend so far inside the pipe that a periodic and faultless cleaning of the nozzle orifices is guaranteed by axial to and fro moving and/or turning, for example brushtype, cleaning devices located inside the spray-showers.

A spray-shower of the above mentioned type has become known, for example, by the DE-GM No. 6 942 564. In the subject of this printed work the spray-shower is enclosed at regular intervals with one piece supporting rings, to which the nozzle base is pivotally attached directed radially outward on the bottom of a radial tapped hole of the nozzle base is located the flat fan nozzle, manufactured by a punching process, one side sealing with the circular shape and from the backside held in place with a tapered retaining plug. The exact alignment of the nozzle discharge orifice in relation to the longitudinal axis of the spray-shower (see above description) has to be done before tightening the retaining plug for each nozzle in the manner of manually turning the nozzle in position. This results in a great consumption of assembly time and also requires great skill of the assembler.

An object of the present invention is to design a spray-shower of the above-mentioned type in a way that the assembly of the flat fan nozzle, located inside the nozzle base, with regard to the exact alignment of the nozzle discharge orifice in relation to the longitudinal axis of the spray-shower, will be substantially easier, and also make possible a variation of the assembly position of the flat fan nozzle, again with regard to the alignment of the nozzle discharge orifice in relation to the longitudinal axis of the spray-shower.

According to the invention the flat fan nozzle has several sides on the outer circumference and on the inner circumference of the nozzle base there are attached corresponding sides used as stops for the sides of the flat fan nozzle.

More particularly, there is a spray-shower having a pipe formed with openings in the pipe wall for accommodating flat fan nozzles. Each flat fan nozzle has a plurality of equal length sides on its outer perimeter defining an equilateral polygon, such as a hexagon. There is nozzle base means for seating in each pipe wall opening and formed with an opening having said plurality of sides also defining said equilateral polygon for mating engagement with said outer perimeter of said flat fan nozzle for supporting the associated flat fan nozzle in the associated pipe wall opening with the plane of the fan spray produced by the flat fan nozzle bearing a predetermined relationship relative to the axis of the pipe determined by the position of the nozzle base in the pipe wall opening. The angle between the axis and the plane is slightly more than 0° so that ends of the spray from the nozzle clear the overlapping ends of any sprays from adjacent nozzles seated in the pipe. The nozzle base means has fixed means for mating engagement with the pipe wall for establishing the orientation of the opening positioned to cause the predetermined relationship between the plane of the fan spray and the pipe axis.

The invention enables a quick assembly without any problems of the flat fan nozzles into the respectively desired exact position, without the need of special skills of the assembler. It eliminates the time consuming control and eventually necessary corrections of the alignment of the nozzle discharge orifice.

The invention facilitates substantially the eventual change of flat fan nozzles (in case of wear of clogging).

Changes of the angular location of the nozzle discharge orifice in relation to the longitudinal axis of the spray-shower can be made as easily and quickly by taking out the nozzles, turning them and relocating them in the desired angular location.

The mentioned advantages of the invention can be optimized when the flat fan nozzle is designed, in regard to the outer circumference with a symmetrical, with respect to rotation, many sided form and the inner circumference of the nozzle base has corresponding, symmetrial, with respect to rotation, many sided form stops, wherefore the aim—to change the angle in the smallest possible steps—is for a several sided form, preferably octagnonal, of flat fan nozzles and inner circumference of the nozzle base.

To enable a simple and economical manufacturing of the nozzle base, including the multi-sided form stops, without need for machining, it is preferred, as an advantageous development of the invention, to design the nozzle base as a casting, preferably investment casting, and to cast the stops for the flat fan nozzle right in it. The edges on the outer circumference of the flat fan nozzle may be manufactured—if they are produced as stamped sheet metal parts—in the simple way of punching.

Figure 1:
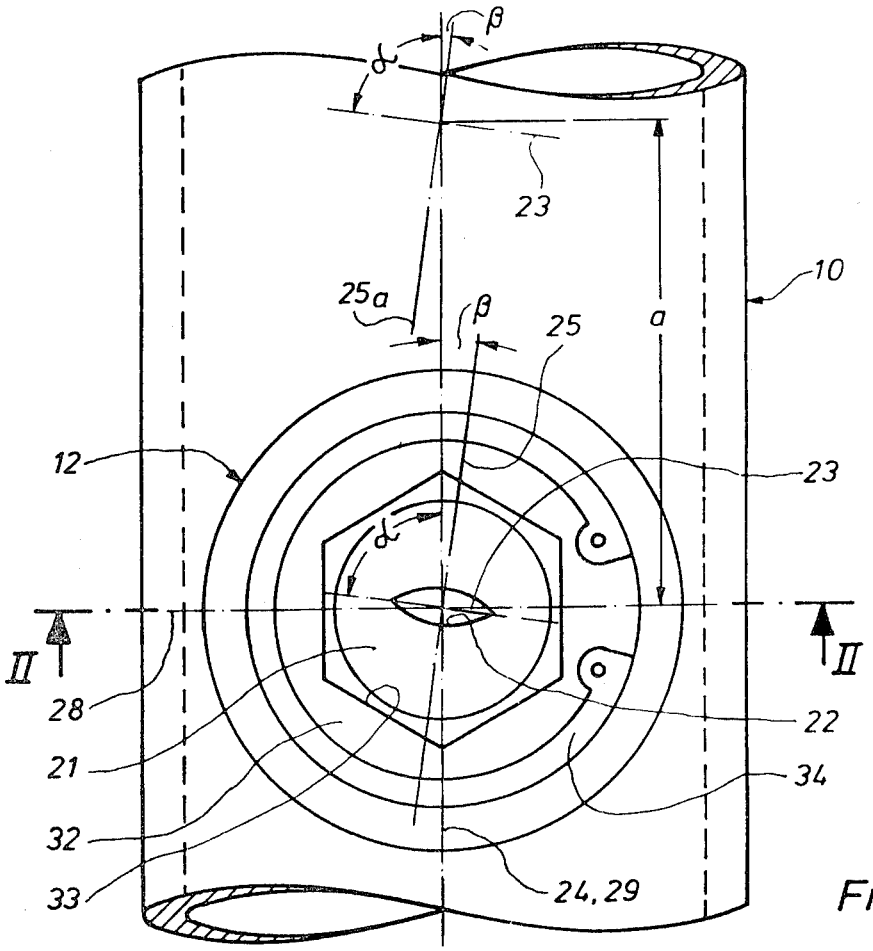
Figure 3:
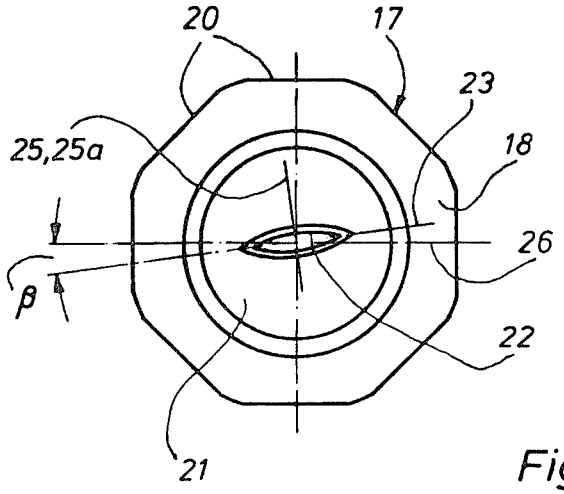
Figure 4:
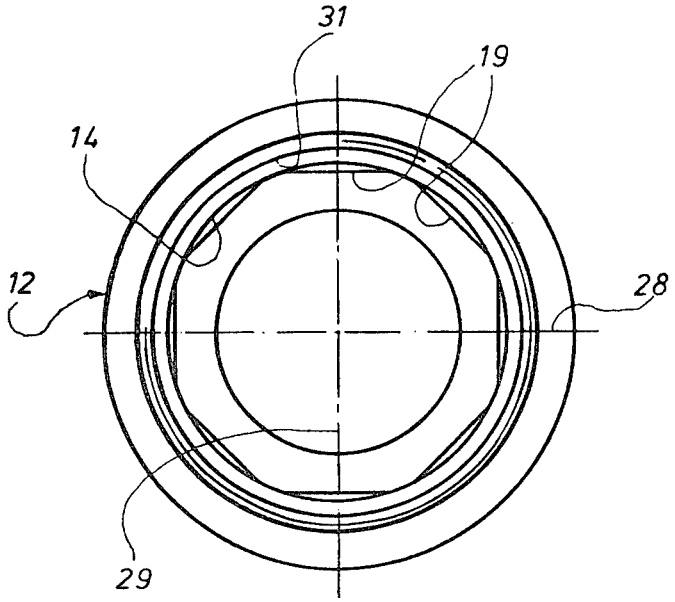

Numerous other features, objects and advantages of the invention will become apparent from the following specification when read in connection with the accompanying drawing in which:

FIG. 1 a part of a spray-shower, showing the top view of the nozzle discharge orifice, FIG. 2 a section line II—II in FIG. 1, FIG. 3 a flat fan nozzle, shown in FIGS. 1 and 2, as a separate part, (direction of arrow A in FIG. 2), and FIG. 4 a nozzle base, how it is used in the object in FIGS. 1 and 2, top view.

In FIGS. 1 and 2 is shown a (partial) spray-shower marked (10). The spray-shower (10) shows on its surface (in FIGS. 1 and 2) a multitude of holes (11), arranged in equal spaces (a), in which is put a nozzle base marked (12). In FIGS. 1 and 2 are shown only one hole

(11) respectively one nozzle base (12). The nozzle bases (12), which are preferably designed as an investment casting (stainless steel or titanium), can—after insertion in the respective holes (11) of the spray-shower (10)—be welded to the spray-shower as indicated by 13.

As follows also from FIGS. 2 and 4, the nozzle base (12) has a cylindrical multi-faceted recess (14), which can be worked into it during the casting process. On a recess (15) at the borehole (14) is located a gasket (16), made of an elastic material. On the gasket (16) lies a flat fan nozzle marked (17) with its horizontal flange (18). As shown, especially in FIG. 3, the stamped and punched part designed flat fan nozzle (17) has at its outer circumference an axially symmetrical octagonal shape. FIG. 4 shows that also the nozzle base (12) has in the area determined for the location of the gasket (16) and nozzle (17) a recess (14) having the octagon shape. The areas (19) which form the inner octagon of the nozzle base (12) service as a stop for the corresponding sides (20) of the flat fan nozzle (17). The flat fan nozzle (17) is thereby in the assembly position, shown in FIGS. 1 and 2, torsion stable connected to the nozzle base (12).

FIG. 2 further on makes clear that the flat fan nozzle (17) has a dome-shaped indentation (21) directed to the pipe inside of the spray-shower (10). At the vertex of the spherical dome-shaped indentation (21) is located the nozzle discharge orifice (22), whose longitudinal axis is marked (23) in FIG. 1. FIG. 1 shows that the longitudinal axis (23) of the nozzle discharge orifice (22) jointly with the spray-shower longitudinal axis marked (24), enclosing an angle of approximately 83° preferably 82.5°. The plane of the flat spray pattern produced by the nozzle discharge orifice (22) is indicated in FIG. 1 with a dotted line and marked (25). The plane (25) of the flat spray pattern is located at a right angle to the longitudinal axis (23) of the nozzle discharge orifice (22). Based on the inclination of the nozzle discharge orifice (22) in relation to the longitudinal axis (24) of the spray-shower there will be obtained a closed angle $\beta$ of approximately 7°, preferably 7.5° between the flat spray pattern (25) and the spray shower longitudinal axis (24) corresponding inclination of the flat spray pattern is also provided for the next following flat spray pattern (25*a*) of the spray-shower (10), a parallel position of the flat spray pattern to one another of the spray-shower (10) is achieved, so that there is avoided the mutual impediment of neighboring flat spray patterns.

The above described inclination of the nozzle discharge orifice (22) in relation to the spray-shower longitudinal axis (24) is obtained—as shown in FIG. 3—through a corresponding inclined location of the nozzle discharge orifice (22) in the flat fan nozzle (17). Thereby is the longitudinal axis (23) of the nozzle discharge orifice (22) forms an angle $\beta$ of approximately 7°, preferably 7.5°, with the main symmetric axis marked (26) of the flat fan nozzle (17). Because the inner octagon (19), as shown in FIG. 4, is cast symmetrically into the nozzle base (12), there suffices for the assembly position according to FIGS. 1 and 2 of the nozzle (17) a simple insertion of the nozzle in the nozzle base (12) without a later adjustment of the necessary angle position of the nozzle discharge orifice (22) in relation to the shower piper longitudinal axis (24). Obviously, determining for the discussed assembly position of the flat fan nozzle (17) and the nozzle base (12) is the direction, shown in FIG. 2, of the curved surface (27) on the underside of the nozzle base (12) in relation to the inside octagon (19). The inside surface (27) of the nozzle base (12) corresponding in curvature to the spray-shower inner wall and surface shown in FIGS. 1 and 4 has a lateral axis of symmetry, marked (28), which is located at a right angle to the longitudinal axis of symmetry (29). The longitudinal axis of symmetry (29) coincides in the assembly position of the nozzle base (12) exactly with the spray-shower longitudinal axis (24).

After insertion of the flat fan nozzle (17) into the mating inner octagon (19) of the nozzle base (12), it is necessary to fix the flat fan nozzle (17) also in the direction of arrow A (see FIG. 2). For this reason the cylindrical recess (14) of the nozzle base (12) has in the zone of the largest diameter an internal thread (31). Into this internal thread (31) is screwed a threaded retaining plug (32) which has a multi-sided opening (33) inside. This opening (33) allows the pass through of the flat spray pattern (in direction of arrow A). The multi-sided opening (33) allows insertion operating of the retaining plug (32) through a corresponding screw spanner. In the assembled position shown in FIG. 2, the retaining plug (32) is pressing with the recessed interface onto the side (18) of the flat fan nozzle (17) with simultaneous compressive-load application of the gasket (16). At the external interface, the retaining plug is secured by a spring-ring (34), installed inside the nozzle base (12).

In this manner inside the nozzle base (12) located and fixed flat fan nozzle (17) is seated—as shown in FIG. 2—with the dome-shaped indentation (21) and nozzle discharge orifice (22) through the opening, marked (35), at the smallest area of the recess (14). Therefore, the nozzle discharge orifice (22) could be reached by an axial to and fro moving and/or turning cleaning device (not shown), located inside the spray-shower (10).

I claim:

1. A spray-shower comprising, a pipe formed with openings in the pipe wall for accommodating flat fan nozzles a flat fan nozzle for each of said openings having a plurality of equal length sides on its outer perimeter defining an equilateral polygon, and nozzle base means for each of said openings each seated in a pipe wall opening and formed with an opening having said plurality of sides also defining said equilateral polygon in mating engagement with said outer perimeter of an associated one of said flat fan nozzles for supporting said associated one of said flat fan nozzles in an associated one of said pipe wall openings with the planes of the fan sprays produced by said flat fan nozzles bearing a predetermined relationship relative to the axis of said pipe determined by the position of said nozzle bases in said pipe wall openings, the angle between said axis and said planes being slightly more than 0° so that the ends of the sprays from said nozzles clear the overlapping ends of any sprays from adjacent nozzles seated in said pipe, said nozzle base means having fixed means for mating engagement with said pipe wall for establishing the orientation of said opening positioned to cause said predetermined relationship.

2. Spray-shower apparatus in accordance with claim 1 wherein the angle between the nozzle discharge orifice and a main axis of symmetry of said figure is a predetermined angle less than 10°.

3. Spray-shower apparatus in accordance with claim 1 wherein said nozzle base means is formed with a front surface having the curvature of the pipe wall inner surface with at least one symmetric axis of said inner curved front surface coinciding with a symmetric axis of said figure.

4. Spray-shower apparatus in accordance with claim 1 wherein said angle is of the order of 7.5°.

5. Spray-shower apparatus in accordance with claim 1 wherein said equilateral polygon is a regular hexagon.

6. Spray-shower apparatus in accordance with claim 5 wherein said nozzle base means is a casting.

7. Spray-shower apparatus in accordance with claim 5 wherein said flat fan nozzle outer circumfernce is formed with a punched flange.

8. Spray-shower apparatus in accordance with claim 7 wherein said nozzle base means is formed with a front surface having the curvature of the pipe wall inner surface with at least one symmetric axis of said inner curved front surface coinciding with a symmetric axis of said figure.

9. Spray-shower apparatus in accordance with claim 5 wherein the angle between the nozzle discharge orifice and a main axis of symmetry of said figure is a predetermined angle less than 10°.

10. Spray-shower apparatus in accordance with claim 5 wherein said nozzle base means is formed with a front surface having the curvature of the pipe wall inner surface with at least one symmetric axis of said inner curved front surface coinciding with a symmetric axis of said figure.

11. Spray-shower apparatus in accordance with claim 1 wherein said novel base means is a casting.

12. Spray-shower apparatus in accordance with claim 11 wherein said flat fan nozzle outer circumference is formed with a punched flange.

13. Spray-shower apparatus in accordance with claim 11 wherein said nozzle base means is formed with a front surface having the curvature of the pipe wall inner surface with at least one symmetric axis of said inner curved front surface coinciding with a symmetric axis of said figure.

14. Spray-shower apparatus in accordance with claim 1 wherein said flat fan nozzle outer circumference is formed with a punched flange.

15. Spray-shower apparatus in accordance with claim 14 wherein said nozzle base means is formed with a front surface having the curvature of the pipe wall inner surface with at least one symmetric axis of said inner curved front surface coinciding with a symmetric axis of said figure.

* * * * *